US005803114A

United States Patent [19]

Johnson

[11] Patent Number: 5,803,114

[45] Date of Patent: Sep. 8, 1998

[54] BACK JET FLUSH TOILET SYSTEMS AND METHODS

[75] Inventor: Dwight N. Johnson, Carlsbad, Calif.

[73] Assignee: American Standard Inc., Piscataway, N.J.

[21] Appl. No.: 612,649

[22] Filed: Mar. 8, 1996

Related U.S. Application Data

[62] Division of Ser. No. 279,637, Jul. 25, 1994, Pat. No. 5,515,556.

[51] Int. Cl.[6] ..... F16K 31/22; F16K 33/00; E03D 11/02

[52] U.S. Cl. ..... 137/404; 4/415; 4/422; 4/425; 137/433

[58] Field of Search ..... 137/187, 188, 137/189, 190, 192, 202, 403, 404, 430, 433; 4/415, 421, 422, 425

[56] References Cited

U.S. PATENT DOCUMENTS

| | | | |
|---|---|---|---|
| 481,098 | 8/1892 | Baker | 137/190 |
| 731,756 | 6/1903 | Cottle | 137/190 |
| 1,013,730 | 1/1912 | Bemish | 137/190 |
| 1,156,684 | 10/1915 | Higgins | 137/190 |
| 1,201,628 | 10/1916 | Robertson | 137/190 |
| 1,232,767 | 7/1917 | Camfield et al. | 4/425 |
| 1,701,936 | 2/1929 | Trerice | 137/190 |
| 4,086,668 | 5/1978 | Tubbs | 4/425 |
| 4,327,764 | 5/1982 | Biederman et al. | 137/192 |
| 4,342,328 | 8/1982 | Matta | 137/433 |
| 4,989,277 | 2/1991 | Tsutsui et al. | 4/367 |
| 5,054,133 | 10/1991 | Pickerrell et al. | 4/428 |

*Primary Examiner*—George L. Walton

[57] ABSTRACT

A flush toilet system includes a bowl that is drained in a flush operation through a flow path including a trap and a siphon. A bypass passage supplies a back jet of water in the reverse flow direction in the flow path. A back jet valve assembly opens to permit back jet flow during only the first part of the interval during which flush water is supplied to the system from a water supply. The kinetic energy of the back jet is converted to static pressure to block or impede flow of flush water through the flow path. Water level increases in the bowl, and when the back jet flow is discontinued a siphon flush operation proceeds. The back flush valve assembly also releases water after the flushing operation in order to reseal the trap.

5 Claims, 3 Drawing Sheets

BACK JET FLUSH TOILET SYSTEMS AND METHODS

This is a division of application Ser. No. 08/279,637 filed on Jul. 25, 1994 fir a Back Jet Flush Toilet Systems and Methods now U.S. Pat. No. 5,515,556.

FIELD OF THE INVENTION

The present invention relates to improved flush toilet systems and methods for reducing flush water consumption.

DESCRIPTION OF THE PRIOR ART

A prior art flush toilet includes a bowl communicating with a drain through a trap system including a trap and a siphon. In the normal or standby condition, the water level in the bowl is at the elevation of the spill over point between an up leg and a down leg of the siphon. In order to flush the bowl into the drain, a flush valve operates to add flush water only to the bowl from a tank or other source. The flush water is supplied throughout a flush interval. The added flush water initiates flow through the trap and siphon. As the siphon down leg fills with water, the weight of the water column in the down leg results in a gravity pump effect to substantially empty the bowl. The bowl is refilled by the final portion of the flush water and, in some cases, by water diverted from the water supply for this purpose. Such a toilet system of a typical size may require about five to seven gallons of water to complete a flush cycle. Consumption of this quantity of water is a disadvantage of the system.

More recently, conventional toilets have incorporated a siphon jet in an attempt to reduce the amount of water required for a flushing operation. In a typical arrangement, a forward jet of water acting in the same direction as the direction of flush water flow is added to the trap system. This forward jet is supplied through the flush valve and continues throughout the flush interval. The forward siphon flow is intended to supply added water in the trap system for encouraging initiation of the siphon operation. Systems of this type have been capable of reducing water consumption in a toilet of a typical size to about three to five gallons.

It has long been an important goal to reduce flush water consumption in toilet systems even further. For example, governmental regulations may require toilet systems to achieve flushing operations with less than two gallons of water. Attempts to solve this long standing problem have not been successful in providing a toilet system that uses small quantities of water without undue complexity resulting from such expedients as air jets, electric motor driven pumps or the like.

SUMMARY OF THE INVENTION

A principal object of the present invention is to provide toilet systems and methods that achieve flushing operations while minimizing water usage. Other objects and advantages are to provide flush toilet systems and methods that do not require air jets, pumps or other complex systems; to provide systems and methods that provide effective flushing operation without adding undue size, complexity or expense to conventional systems and methods; and to provide flush toilet systems and methods overcoming disadvantages of conventional systems and methods.

In brief, in accordance with the present invention there is provided a flush toilet system including a drain port, a bowl and a trap system defining a flow path extending in a forward flow direction from the bowl to the drain port. The trap system includes a trap and a siphon in the flow path. The siphon includes a spill over point, an up leg extending to the spill over point and a down leg extending from the spill over point. Means is provided for supplying a quantity of flush water to the bowl during a flush interval. In accordance with the invention, the flush toilet system includes means for introducing a back jet of water into the flow path in a reverse flow direction opposed to the forward flow direction in order to oppose flow from the bowl through the trap system.

In accordance with another aspect of the present invention, there is provided a method of operating a flush toilet including the steps of adding flush water to a toilet bowl to cause a siphon flushing flow in a forward direction from the bowl to a drain through a trap system including a trap and a siphon, and delaying flow through the trap system to permit the toilet bowl water level to increase during the step of adding flush water.

BRIEF DESCRIPTION OF THE DRAWING

The present invention together with the above and other objects and advantages may best be understood from the following detailed description of a preferred embodiment of the invention illustrated in the drawings, wherein.

DETAILED DESCRIPTION OF THE PREFERRED EMBODIMENT

Figure 1:
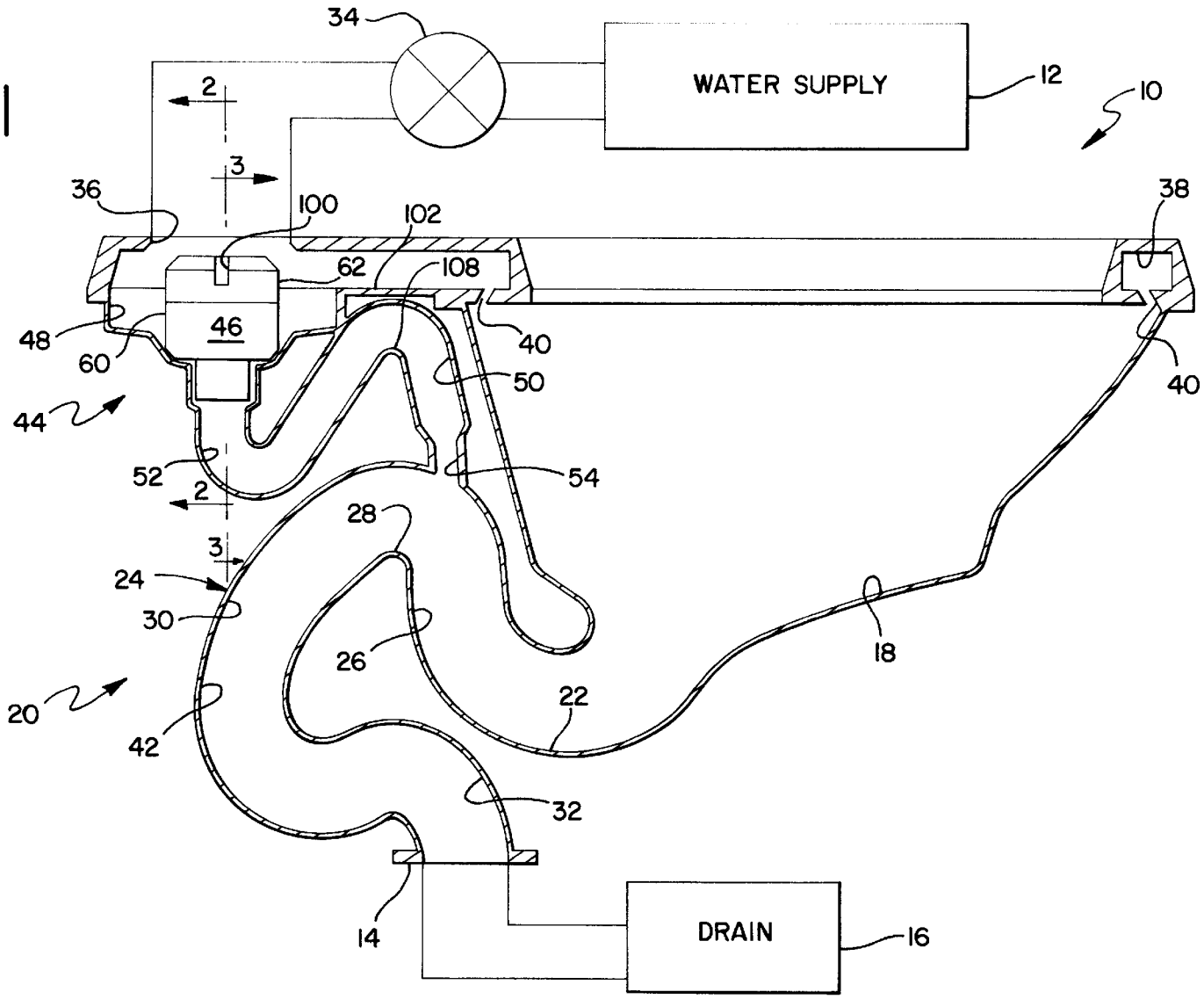
FIG. 1 is a schematic and diagrammatic illustration of a flush toilet system embodying the present invention.
Figure 3:
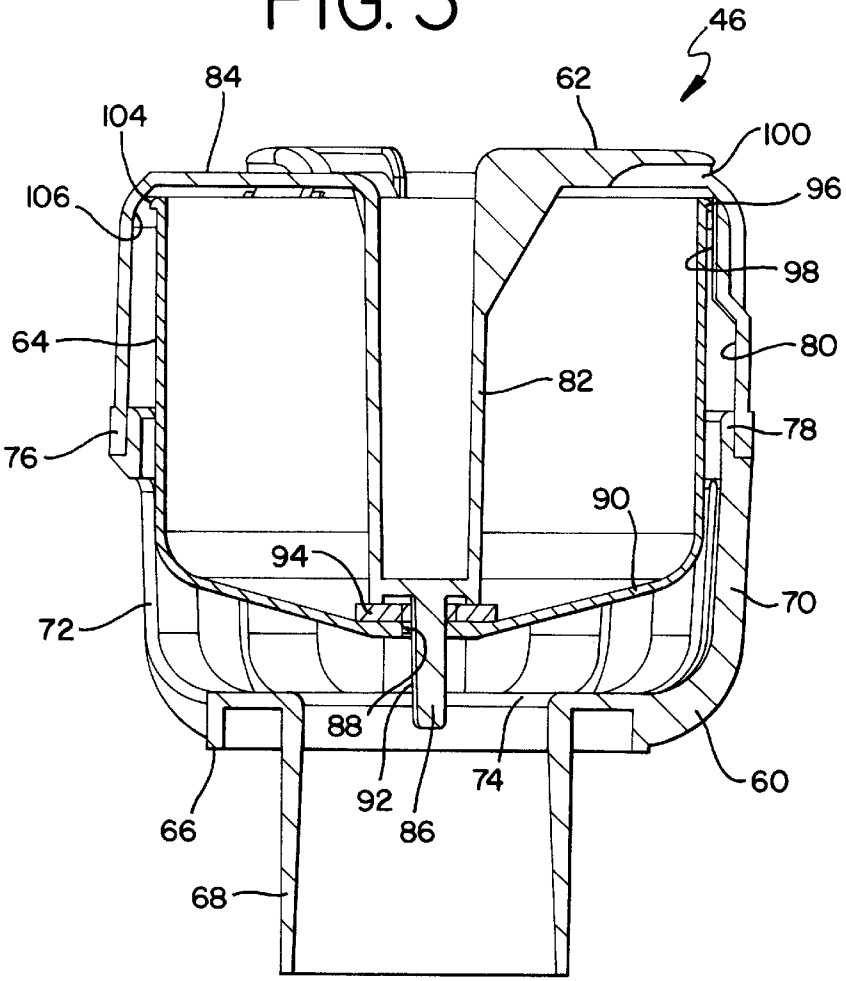
FIG. 3 is a view similar to FIG. 2, but taken in the opposite direction along the line 3—3 of FIG. 1, and showing the valve in the open position.
Figure 2:
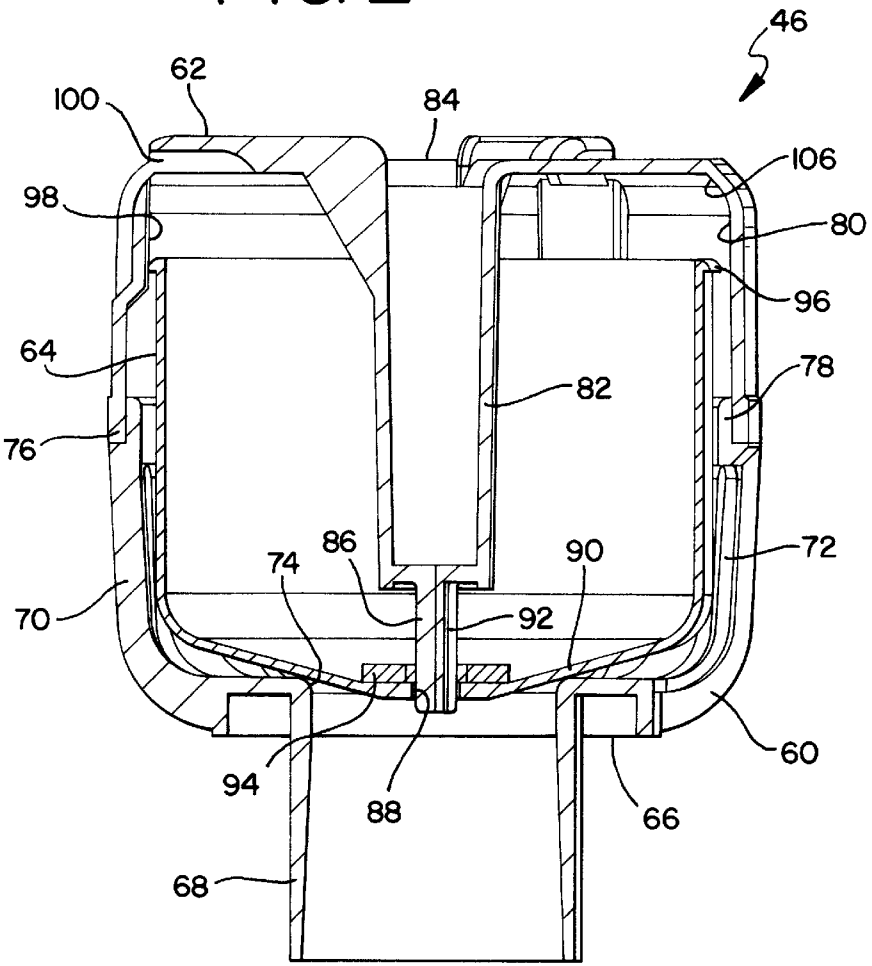
FIG. 2 is a sectional view on an enlarged scale of the back jet control valve assembly of the system of FIG. 1, taken along the line 2—2 of FIG. 1 and showing the valve in the closed position.
Figure 5:
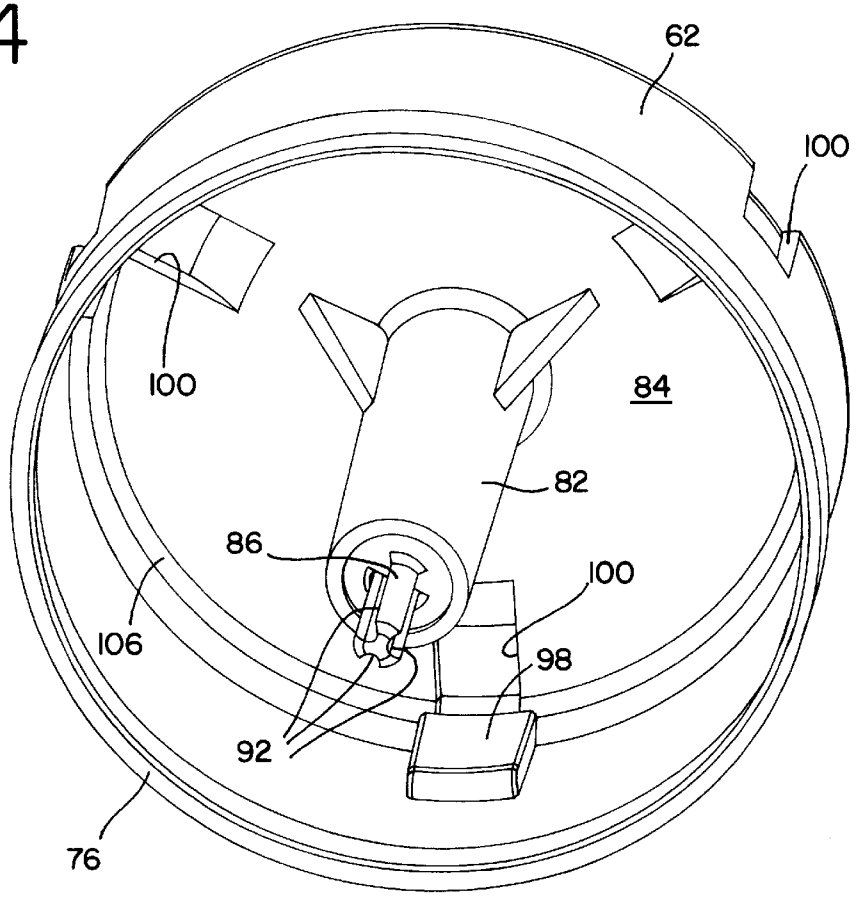
FIG. 5 is an enlarged isometric view showing the interior of the cover of the back jet control valve.
Figure 4:
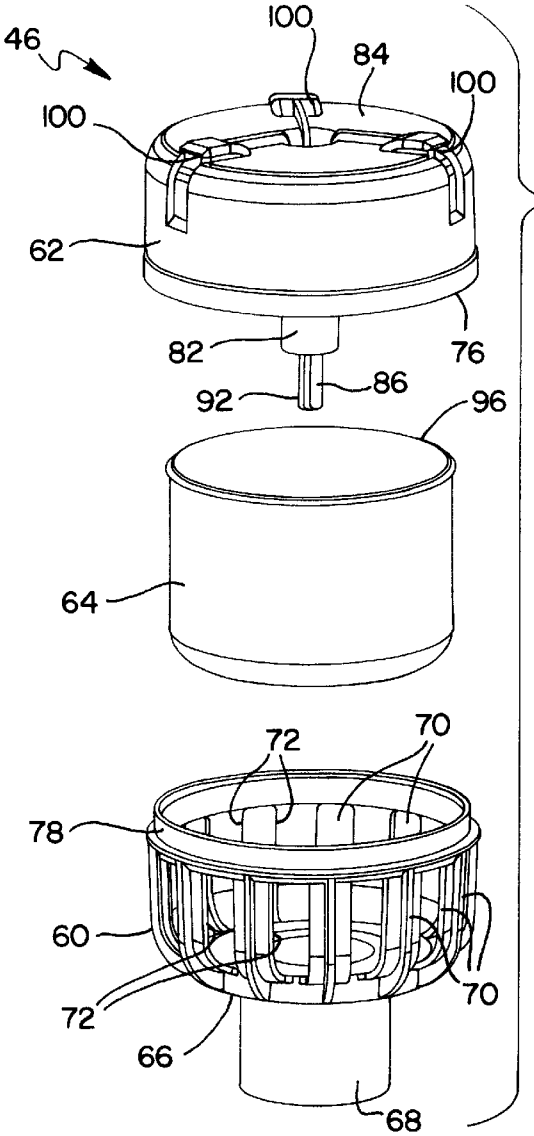
FIG. 4 is an isometric exploded view of the components of the back jet control valve assembly.

Having reference now to the drawings, in the schematic and diagrammatic illustration of FIG. 1 there is shown a flush toilet system generally designated as 10 constructed in accordance with the principles of the present invention. The system 10 is supplied with water from a water supply 12, and includes a drain connection 14 communicating with a drain 16. In a typical household system, for example, the water supply 12 may be an elevated toilet water tank normally filled to a predetermined level by a fill valve such as disclosed in copending U.S. Pat. No. 5,255,703, incorporated here by reference, and the drain 16 may be a vented waste stack.

In general, the flush toilet system 10 includes a bowl 18 that communicates with the drain connection 14 through a trap system generally designated as 20. The trap system 20 includes a trap 22 and a siphon 24 having an up leg 26, a spill over point 28 and a down leg 30 leading to the drain connection 14 through an outlet conduit 32. In the normal standby condition of the 5 system 10, the bowl 18 is filled with water to a level equal to the elevation of the spill over point 28, and water in the trap 22 provides an air seal between the drain 16 and the bowl 18.

A normally closed flush valve 34 is connected between the water supply 12 and the system 10. To carry out a toilet flushing operation, the flush valve 34 is opened for a period of time, or flush interval, to permit flush water to flow into the bowl 18. In a typical residential system the flush valve may be a flapper type valve cooperating with the outlet valve seat in a toilet water tank as disclosed in U.S. Pat. No. 4,499,616 incorporated here by reference.

Flush water flowing through the flush valve 34 is supplied through an inlet port 36 of the system 10 to a rim wash conduit 38 extending around the rim of the bowl 18. Numerous rim wash ports 40 direct flush water across the bowl surface to wash down the bowl, and also impart a swirling motion to water in the bowl 18. During the flushing operation, water flows from the bowl 18 in a forward flow direction along a main flush water flow path 42 through the trap 22 and siphon 24. When the down leg 30 of the siphon 24 fills with water, the weight of that water causes a gravity pump siphon operation that substantially empties the bowl 18.

In accordance with the present invention, there is provided a back jet assembly generally designated as 44. When a flushing operation is carried out by the system 10, the back jet assembly serves to delay the initiation of the siphon operation while the water level in the bowl 18 increases so that an effective flushing operation is achieved with minimum water usage. Generally, the back jet assembly 44 includes a back jet valve assembly 46 mounted in a reservoir 48 controlling flow from the inlet port 36 through a bypass passage 50. The valve assembly 46 permits flow during only a first portion of the flush operation. The passage 50 includes a bypass trap 52 that provides a water seal in the standby condition between the drain 16 and the reservoir 48.

Passage 50 also includes a back jet orifice 54 directed in the reverse flow direction with respect to the main flush water flow path 42. In the illustrated embodiment of the invention, the orifice 54 is generally aligned with the siphon up leg 26 and is located somewhat above the elevation of the spill over point 28. The orifice 54 increases the velocity of water flow and converts static pressure into kinetic energy of the back jet flowing in the reverse direction in the flow path 42. The kinetic energy of the back jet is converted back into static pressure and functions to impede or block flow in the forward direction through the flow path 42. Water level in the bowl 18 increases to an elevation substantially above the standby elevation of spill over point 28. When the back jet is discontinued, the bowl is flushed effectively through the siphon 24.

The structure of the back jet valve assembly 46 is seen in FIGS. 2–5. In general it includes a base 60 and cover 62 enclosing a float cup 64. The base is generally cup shaped and is received in the reservoir 48 with a lower ridge 66 providing a seal against the bottom wall of the reservoir 48 and a skirt portion 68 extending down into the bypass passage 50. The side wall of the base 60 includes ribs 70 defining a plurality of flow ports 72. The upper region of the skirt portion 68 defines a valve seat 74 through which water may flow into the passage 50.

Cover 62 has an inverted cup shape with its downward rim 76 mated to the upward rim 78 of the base 60 to define an enclosure 80 for the float cup 64. A central post 82 depending from the top wall 84 of the cover 62 terminates in a guide pin 86 received in a central opening 88 in the bottom wall 90 of the float cup 64. The pin 86 guides the cup 64 in a limited range of vertical movement within the enclosure 80. In the lower position of cup 64 (FIG. 2), the bottom wall 90 of the float cup 64 engages the valve seat 74 to prevent flow through the back jet valve assembly 46. In the upper position (FIG. 3), back jet water flows through the valve assembly 46.

Grooves 92 in the pin 86 provide a restricted flow path for gradually releasing water from the interior of the float cup 64. A seal disk 94 is engaged between the bottom wall 90 of the float cup 64 and the end of the post 82 to prevent flow through the grooves 92 when the cup 64 is in the upper position of FIG. 3. Float cup 64 has an outwardly projecting continuous upper rim 96 that moves with little clearance across the surfaces of a plurality of blocking lugs 98 formed on the inside of the cover 62. Above each lug 98 is a vent opening 100.

Valve assembly 46 performs two functions in connection with the operation of the system 10. The first is a timing function in accordance with which back jet flow is permitted from the time that flush water flow begins and is discontinued following a predetermined time interval. The second function is a gradual and controlled emptying of the reservoir 48 following a flush operation to refill and reseal the trap 22.

Initially, in the standby position, the valve assembly 46 is surrounded by air and the float cup 64 is empty. The cup is in its lower position (FIG. 2) and the upper rim 96 is located just above the bottom wall 102 (FIG. 1) of the rim wash conduit 38. When the assembly 46 is immersed in water at the beginning of a flushing operation, water enters the enclosure 80 through the flow ports 72 and fills the enclosure. The empty float cup 64 floats in the surrounding water to its upper position (FIG. 3) and opens the valve assembly 46 to permit relatively unrestricted flow through the valve seat 74.

The area of a gap 104 defined between the upper cup rim 96 and the interior wall 106 of the cover 62 is establishes the length of time that the valve assembly 46 remains open. After the cup 64 reaches its upper position, water is metered through the gap 104 and fills the cup 64. Displaced air escapes through the ports 100 that are shielded from water by the lugs 98. After a predetermined time, the cup 64 is filled and has neutral buoyancy in the surrounding water within the enclosure 80. The drop in pressure caused by the flow of water below the cup bottom wall 90 and through the valve seat 74 causes the cup 64 to descend to the lower, valve closed position of FIG. 2. The duration of time that the valve is open can be tailored to system requirements by varying the area of the gap 104.

After the conclusion of the flushing operation, the rim wash conduit 38 is empty of water, but a quantity of water is retained in the reservoir 48 below the level of the bottom wall 102 of the rim wash conduit 38. The float cup 64 is slowly emptied as water flows through the central opening 88 and restricted grooves 92. As the level of water in the cup 64 falls below the level of water in the reservoir 48, the cup 64 floats slightly above the valve closed position and gradually releases water from the reservoir through the valve seat 74.

A cycle of operation of the flush toilet system 10 begins in an initial standby condition. The bowl 18 is filled with water to the level of the spill over point 28 and the trap 22 is filled. The rim wash conduit 38 and the reservoir 48 are empty. The bypass trap 52 is filled with water to the level of its spill over point 108, preferably about the elevation of the bottom of the reservoir 48.

A flushing operation is initiated when the flush valve 34 opens for a predetermined time period, or flush interval. In a preferred embodiment of the present invention, the flush interval lasts about eight seconds. Flush water flows from the water supply 12, through the flush valve 34 and into the inlet port 36 throughout this flush interval. Flush water floods the rim wash conduit 38 and the reservoir 48. The back jet valve assembly 46 opens to permit flow through the bypass passage 50 and back jet orifice 54 for a period of time shorter than the flush interval as regulated by the valve assembly 46. In a preferred embodiment of the invention, the back jet flow continues for about two or three seconds. During this time period, roughly one half of the flush water flow enters the bowl 18 through the rim wash ports 40 and the other one half flows through the back jet orifice 54.

Flow in the forward direction through the main flush water path 42 is blocked or impeded during the period of time that back jet flow occurs. As a result, the level of water in the bowl 18 rises. The rise in water level occurs not only because water is added to the bowl through the rim wash ports 40 but also because the back jet water also enters the bowl 18. In a preferred embodiment of the invention, the water level in the bowl rises about two inches above the level of the spill over point 28 during the back jet flow period.

When the back jet flow is discontinued by closing of the back jet valve assembly 46, the static pressure head of the elevated water in the bowl initiates an effective flushing operation. The siphon down leg 30 rapidly fills with a solid mass of water. Gravity acts upon this body of water to cause a siphoning action which quickly draws substantially all of the water from the bowl 18. The bowl empties at about the end of the flush interval when the flush valve 34 recloses.

After the flush valve 34 closes, the water remaining in and above the rim wash conduit 38 enters the bowl 18 through the rim wash ports 40. The bowl 18 and trap 22 are partly refilled, but typically the water level attained by this remaining water is somewhat below the standby level of the spill over point 28. It is necessary to completely refill the bowl and trap to assure that the water seal is adequate. The valve assembly 46 slowly releases the water trapped in the reservoir 48 and permits that water to flow through the bypass passage 50 to completely refill the bowl 18 and trap 22. One result is that it is not necessary to divert refill water from the supply 12.

In a preferred embodiment of the invention, the residual water flow into the bowl is completed about four to six seconds after the eight second flush water interval, and the reseal water flow from the reservoir 48 continues for about thirty seconds thereafter, providing time for refill of a conventional residential flush water tank. In a preferred embodiment of the invention, the entire flushing operation uses about one and one half gallons of water. Typically the components of the system including the bowl 18, trap system 20, rim wash ports and conduit 40 and 38, reservoir 48 and bypass passage 50 are formed as part of a ceramic fixture.

While the present invention has been described with reference to the details of the embodiments of the invention shown in the drawing, these details are not intended to limit the scope of the invention as claimed in the appended claims.

What is claimed is:

1. A valve assembly for providing a timed valve open operation, said valve assembly comprising:

a housing;

a valve seat in said housing defining an outlet;

float captured in said housing for movement between a lower, closed position in which said float closes said valve seat and an upper, open position in which said float opens said valve seat;

a first restricted flow path which allows water to enter said float for displacing air in said float with a metered flow of water in order to move said float from said open position to said closed position a predetermined time after said housing is filled with water;

a second flow path for draining water from said float after said housing is emptied of water in order to prepare said float to move from said closed position to said open position when said housing is filled with water; and a third flow path defined intermediate said float and said valve seat for providing flow through said valve seat and out of said housing when said float is in said open position.

2. A valve assembly as claimed in claim 1 wherein said float comprises a cup having an upper rim and a bottom wall engageable with said valve seat.

3. A valve assembly as claimed in claim 2, said first restricted flow path comprising a gap defined between said upper rim and said housing.

4. A valve assembly as claimed in claim 3 said second flow path comprising a flow restriction orifice in said bottom wall aligned with said valve seat.

5. A valve assembly as claimed in claim 4, said housing including a restrictor pin received in said restriction orifice.

* * * * *